US007210642B2

(12) United States Patent
Cook et al.

(10) Patent No.: US 7,210,642 B2
(45) Date of Patent: May 1, 2007

(54) COMMINUTING APPARATUS AND ROTOR THEREFOR

(76) Inventors: Phillip Malcolm Cook, 219 North Road, Clevedon, Auckland (NZ); Brian David Court, Robinsons Road, Broadfileds, Christchurch (NZ)

( * ) Notice: Subject to any disclaimer, the term of this patent is extended or adjusted under 35 U.S.C. 154(b) by 0 days.

(21) Appl. No.: 10/485,213

(22) PCT Filed: Jul. 30, 2002

(86) PCT No.: PCT/NZ02/00141

§ 371 (c)(1),
(2), (4) Date: Aug. 11, 2004

(87) PCT Pub. No.: WO03/011467

PCT Pub. Date: Feb. 13, 2003

(65) Prior Publication Data

US 2005/0001083 A1 Jan. 6, 2005

(30) Foreign Application Priority Data

Jul. 30, 2001 (NZ) ..... 513250

(51) Int. Cl.
*B02C 18/16* (2006.01)

(52) U.S. Cl. ..... 241/74; 241/282.1

(58) Field of Classification Search ..... 241/74, 241/282.1, 282.2, 277, 101.761, 186.4, 69, 241/254, 257.1
See application file for complete search history.

(56) References Cited

U.S. PATENT DOCUMENTS

| | | | | |
|---|---|---|---|---|
| 2,573,709 A | * | 11/1951 | Hill et al. | 165/65 |
| 4,249,702 A | | 2/1981 | Miller | |
| 5,297,744 A | | 3/1994 | Clinton | |
| 5,379,951 A | * | 1/1995 | Hughes | 241/60 |
| 5,927,624 A | | 7/1999 | Hughes | |
| 5,950,942 A | | 9/1999 | Brand et al. | |
| 5,975,448 A | * | 11/1999 | Gygi | 241/245 |
| 6,113,016 A | | 9/2000 | Vedefors | |

FOREIGN PATENT DOCUMENTS

| | | |
|---|---|---|
| EP | 0 244 977 A1 | 11/1987 |
| EP | 0 407 112 A1 | 1/1991 |
| EP | 0 244 977 B1 | 7/1991 |
| FR | 2 715 329 | 7/1995 |
| JP | 11-342346 A2 | 12/1999 |
| SU | 1369-791 A | 1/1988 |
| WO | WO 95/10176 | 4/1995 |

OTHER PUBLICATIONS

Cook et al., International Search Report for PCT/NZ02/00141 filed Jul. 30, 2002.

* cited by examiner

*Primary Examiner*—Faye Francis
(74) *Attorney, Agent, or Firm*—Nixon Peabody LLP; Jeffrey L. Costellia

(57) ABSTRACT

A rotor (1) for use in a comminuting apparatus (100) is described and claimed. The rotor (1) includes a hub (2) rotatable about a first axis (A) and one or more disc members (4) for comminuting material. The disc members (4) are secured to the hub (2) and rotatable about a second axis (B), removed from the first axis (A). Drive means is provided to simultaneously rotate the hub (2) disc members (4) about their respective axes. Guides (11) may be provided below the disc members (4) to remove comminuted material after it has passed through a screen (10). The screen (10) may include base portion (10A) and side wall portion (10B), the side wall portion (10B) extending up to a level approximately level with the disc members (4). The guides (11) may include arms (11A) extending up beside the side wall portion (10B). A comminuting apparatus (100) including a rotor (1) is also claimed.

15 Claims, 4 Drawing Sheets

COMMINUTING APPARATUS AND ROTOR THEREFOR

TECHNICAL FIELD

This invention relates to improvements in and relating to comminuting apparatus and in particular, to a rotor for a comminuting apparatus.

BACKGROUND

Apparatus for comminuting materials have application to a number of industries, which may involve shredding of wood, bales of hay or paper, comminuting bitumen, plastic, metal or other materials. An effective comminuting apparatus has a high throughput, does not jam often, is reliable, easy to maintain, is energy efficient and comminutes relatively uniformly Tub grinders are well known devices for grinding various materials. Vertical feed tub grinders have the advantage of using gravity to force the material onto the rotor, reducing or eliminating the need for further conveying means for the material other than that required to feed the material into the tub. However, one problem with tub grinders is their tendency to jam.

Another problem with known tub grinders at present is apparent when they are used to comminute lighter material such as paper. The turbulence, vortices and movement of the rotor against the material tends to force the material upwards. Therefore, intervention may be required to force the material onto the rotor and through the screens.

A comminuting apparatus including a rotating tub is described in the specifications of U.S. Pat. Nos. 5,379,951 and 5,927,624. Within the tub is mounted a toothed disc that preferably rotates in the opposite direction to the tub. The problem of potential jamming is stated to be overcome or reduced by reversing the direction of rotation of the toothed disc and/or by providing a reorienting attachment secured to the bottom of the chamber defined by the tub. However, such a comminuting apparatus may still be susceptible to jamming.

It is an object of the present invention to provide a comminuting apparatus that may be freed from jamming, optionally automatically and/or has improved operation for lighter materials.

It is a further or alternative object of the present invention to provide the public with a useful alternative.

Further objects of the present invention may become apparent from the following description.

DISCLOSURE OF THE INVENTION

According to one aspect of the present invention, there is provided a rotor for use in a comminuting apparatus, the rotor including a hub rotatable about a first axis, one or more disc members for comminuting material, the disc members secured to said hub and rotatable about a second axis removed from said first axis and drive means to simultaneously rotate said hub and said one or more disc members about their respective axes.

Preferably, the rotor may include a plurality of disc members along the second axis, each of the plurality of disc members rotatable about the second axis.

Preferably, the rotor may include two or more sets of said one or more disc members, the sets each secured to the hub and distributed about the first axis.

Preferably, the drive means may include a first drive means for the hub and a second drive means, independently controllable from the first drive means, for the one or more disc members.

Preferably, the rotor may include a sensor to detect jamming of the rotor and a controller in communication with the sensor to control the drive means to either stop the rotation of the hub or reverse the direction of rotation of the hub in response to the detection of a jam by the sensor.

Preferably, the rotor controller may control the drive means to resume the original rotation of the hub once the one or more disc members are rotating at or above a predetermined minimum speed.

Preferably, the rotor may further include at least one guide for directing comminuted material extending radially outward in relation to said first axis and rotatable about the first axis below the one or more disc members.

Preferably, the at least one guide may be rotatable independently of the hub and the one or more disc members.

According to another aspect of the present invention, there is provided a comminuting apparatus including a receptacle to receive material to be comminuted and a rotor as described in the immediately preceding paragraphs positioned with the one or more disc members in said receptacle, wherein the comminuting apparatus includes a screen to provide an exit path for comminuted material, the screen having a base portion extending across said receptacle below the one or more disc members and a side wall portion extending upwards from said base portion at the periphery of the receptacle.

Preferably, the screen may a base portion extending across said receptacle below the one or more disc members and above the at least one guide and a side wall portion extending upwards from said base portion at the periphery of the receptacle.

Preferably, the at least one guide may include a peripheral portion that extends towards the one or more disc members beside the side wall portion of the screen.

Preferably, the at least one guide may extends towards the one or more disc members beside the side wall portion so as to terminate at least approximately in the plane of the lowest of the one or more disc members.

Preferably, the comminuting apparatus may include a baffle below said screen, the baffle shaped to direct comminuted material radially outwards from said first axis.

Preferably, the comminuting apparatus may include a baffle below said screen, the baffle shaped to direct comminuted material radially outwards from said first axis, wherein said at least one guide extends radially outward from the outer periphery of said baffle.

Further aspects of the present invention, which should be considered in all its novel aspects, will become apparent from the following description, given by way of example only and with reference to the accompanying drawings.

MODES FOR CARRYING OUT THE INVENTION

The present invention relates to a comminuting apparatus and a rotor therefor. The rotor includes one or more blades that rotate and travel about a central axis. This action may provide more effective freeing of the rotor after it becomes jammed through reversal of the direction of rotation about the first axis.

The comminuting apparatus includes a hopper having a screen at its lower end below and to the sides of the rotor. The screen allows comminuted material therethrough to a collection receptacle. The movement of the second rotating member about the first rotating member may force material through the side portions of the screen. This provides an alternative path out of the comminuting apparatus, which may allow lighter material that does not easily travel to the base of the screen to be removed from the hopper of the apparatus.

Figure 1:
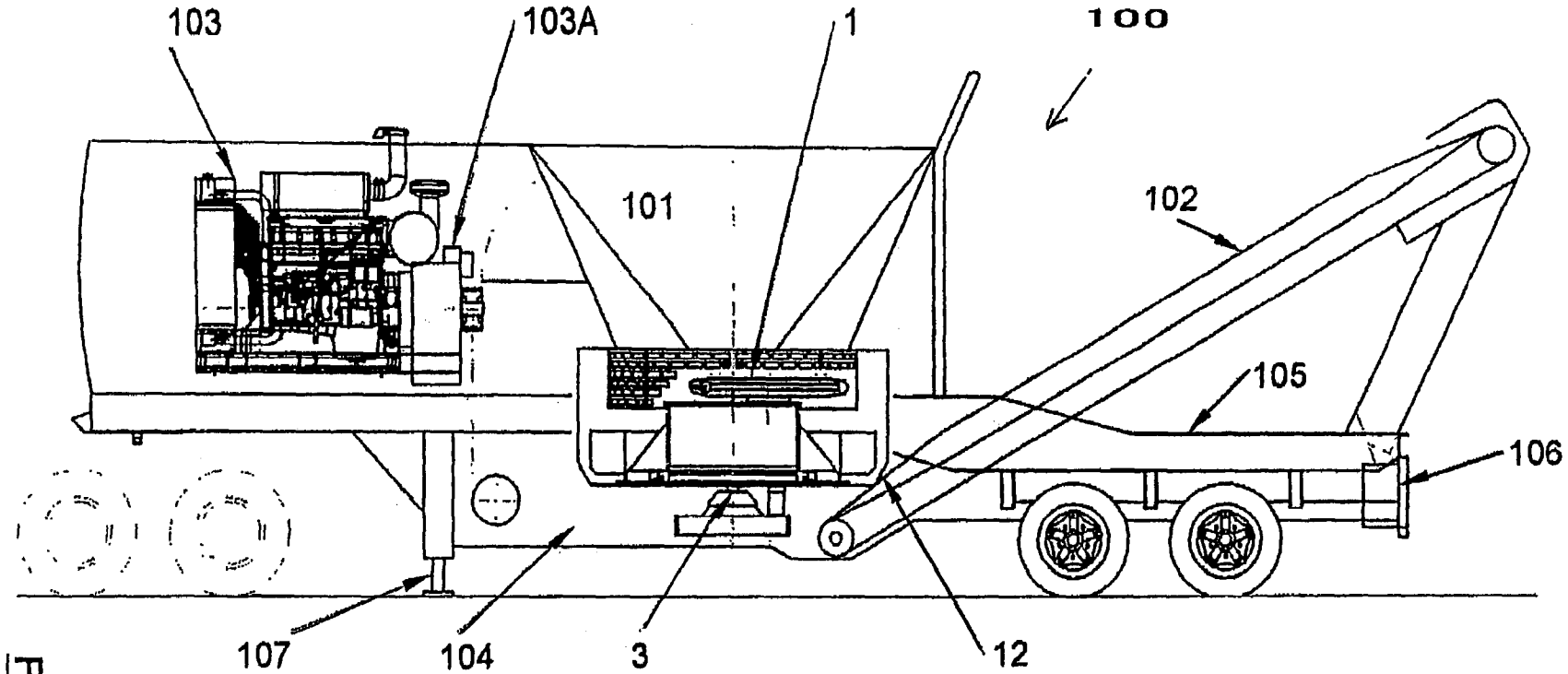
FIG. 1: Shows a partial cutaway view of a comminuting apparatus according to one aspect of the present invention.

Referring to the accompanying figures, FIG. 1 shows a partial cutaway view of a comminuting apparatus generally referenced by arrow 100. The comminuting apparatus 100 includes a rotor 1, shown in more detail in FIGS. 2 and 3.

The comminuting apparatus in FIG. 1 is mounted so as to have a substantially vertical feed. Therefore, the action of gravity is utilised to apply material to the rotor 1. The comminuting apparatus 100 may be oriented so as to provide a feed that is other than vertical if required. However, the preferred form of the invention has a vertically or substantially vertically oriented feed.

The comminuting apparatus 100 shown in FIG. 1 is configured to be transportable by road, more particularly as a semi-articulated trailer. It will be appreciated by those skilled in the relevant arts, that different configurations of the components of the comminuting apparatus may be applied if the comminuting apparatus was part of a processing line or other application.

Material to be comminuted is fed to the rotor 1 through a hopper 101, by suitable loading machinery, which will vary depending on the location of the comminuting apparatus 1 and the material to be comminuted. Comminuted material is extracted by a discharge conveyor 102 through an exit 12, typically to a deck of a truck, directly onto the ground or onto further processing. The rotor is driven by an engine 103 linked to a drive shaft 3 of the rotor 1. In this embodiment, the linkage between the engine 103 and drive shaft 3 is a pulley system 104. Other linkages may be used if required; including a direct link should the engine 103 be mounted directly below the rotor 1.

The rotor 1, hopper 101, engine 103, pulley system 104 and discharge conveyor 102 are all mounted onto the chassis 105 of a trailer 106, to provide a transportable comminuting apparatus. The trailer 106 may include supports 107, to allow the trailer 106 to stand unsupported by a truck.

Figure 2:
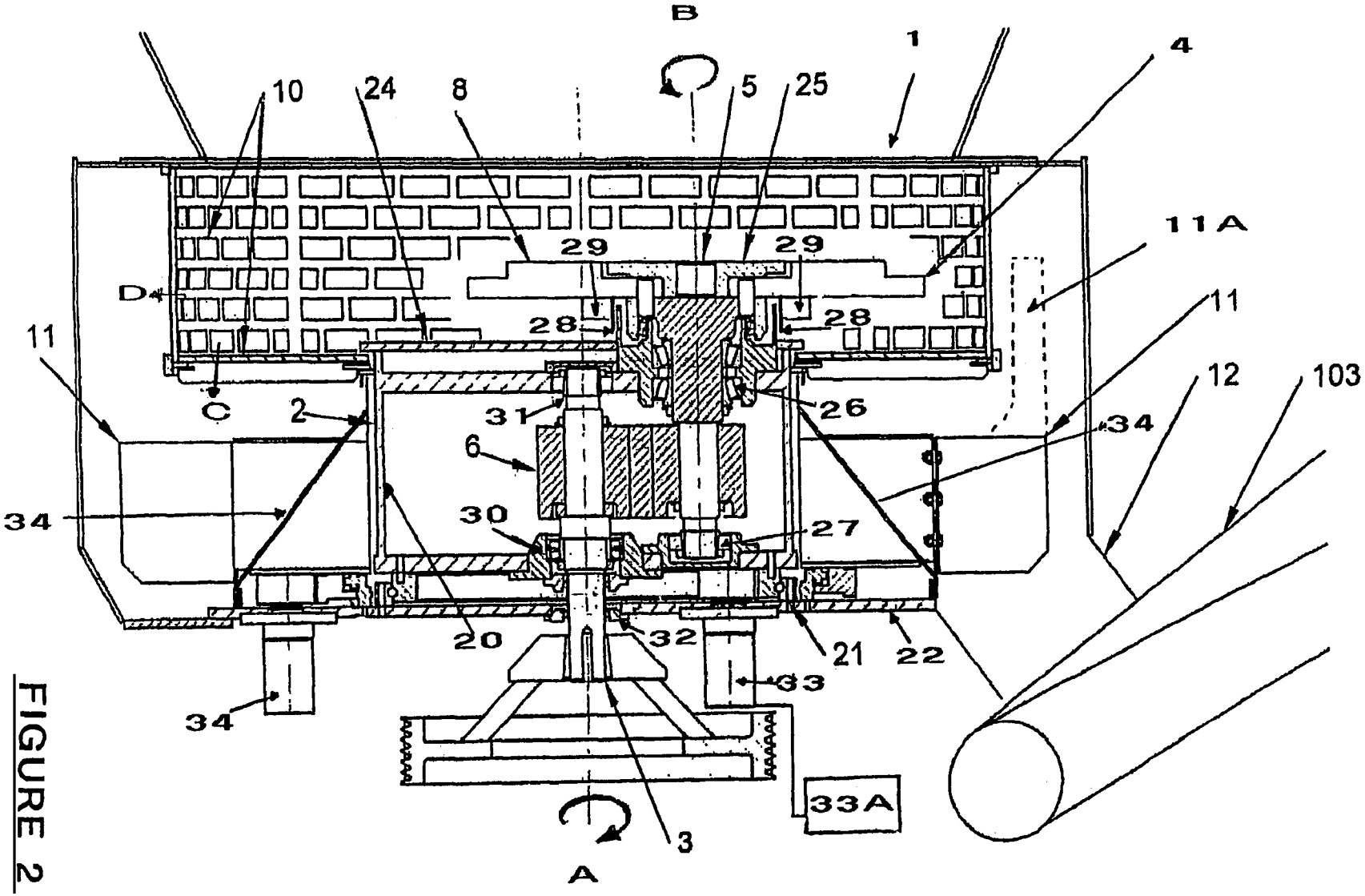
FIG. 2: Shows a sectional view through the rotor of the comminuting apparatus of FIG. 1.

Referring to FIG. 2, which shows an enlarged sectional view of the rotor 1, the rotor 1 is supported on an outer frame 22, which in turn is supported by the chassis 105. The rotor 1 includes, coupled to the drive shaft 3 a hub 2, rotatable about a first axis A under the control of the engine 103 through the pulley system 104 and the drive shaft 3. The hub 2 includes vertical supports 20 about its circumference and is rotatably engaged to the drive shaft 3 by bearings 30 and 31. The hub 2 may further engage with the frame 22 through assembly 21 located around the hub 2. The assembly 21 may include a bearing arrangement, for example a slew ring or rotary bearing to facilitate rotation of the hub 2 relative to the frame 22. The drive shaft 3 enters the hub 2 through a seal 32, provided to prevent the ingress of material into the hub 2. The hub 2 has a cover 24 extending across a portion of the bottom of the hopper 101.

A disc 4, shown schematically in FIG. 2, is provided that is rotatable about a second axis B, defined by a shaft 5, which extends through the hub 2 at a location removed from the first axis A. A turning moment is imparted to the shaft 5 by a suitable drive train 6 from the drive shaft 3, The drive train 6 may be a simple belt/chain drive or may include a differential, clutch and/or gearing with associated oil pump, pressure sensors, valves and filters if required. The shaft 5 may rotate synchronously with the drive shaft 3. The shafts 3, 5 may rotate in the same direction or in opposite directions.

As shown in FIG. 1, the disc 4 preferably extends over the edge of the hub 2 to extend close to the side of the hopper 101. The disc 4 is held in position over the shaft 5 by a cap 25 and the shaft 5 is held in position relative to the hub 2 through bearings 26 and 27. Guards 28 are provided below the disc 4 to prevent the ingress of material into the area of the shaft 5.

The hub 2 is rotated by a hydraulic motor 33 independently of the rotation of the shafts 3 and 5. The hydraulic motor 33 is operable in both directions under the control of a controller 33A.

In an alternative embodiment, with appropriate positioning of the motor 33 and/or linkage to the motor 33, only the upper portion of the hub 2 may rotate, with the remainder of the housing being static or omitted. Those skilled in the relevant arts will appreciate that there are a number of alternatives to the hub 2, which may be used to provide a rotating member to move the shaft 5 and disc 4 about the axis A.

A screen 10 is provided to allow material to exit the rotor area once the material has been comminuted to a sufficiently small size. The screen 10 has a base portion 10A and side wall portion 10B. Gravity assists in the movement of material through the base portion 10A as indicated by arrow C and the rotational movement of the disc 4 about the hub 2 tends to force material through the side wall portion 10B as indicated by arrow D. For lighter material, the movement of the rotor 1 may impede downward travel, therefore, by providing a screen about the sides of the rotor 1, an alternative exit route for lighter material is provided. The screen 10 preferably is static, with the disc 4 and hub 2 rotating within the confines of the screen 10.

Below the screen 10, two guides 11 are provided, which are driven to rotate below the screen 10. The guides 11 act to wipe the comminuted material to the exit 12, to be conveyed away by the discharge conveyor 102. One or more than two guides 11 may alternatively be provided. The guides 11 may be independently driven and reversible by a motor 34. The speed of rotation may be variable in either or both directions, allowing comminuting of various materials. For example, softer materials, such as green waste tend to be shredded quicker than harder materials and therefore the guides need to rotate at a higher rate to move material to the exit 12 faster. For harder materials, a high rate of rotation may create positive pressure below the screen 10, inhibiting passage of comminuted material through the screen 10. For comminuting wood, a screen mesh size of between 50 $mm^2$ to 300 $mm^2$ and a clearance of approximately 100 mm between the screen 10 and the guides 11 has been found suitable.

Baffles 35 may be provided to direct comminuted material radially outward. The baffles 35 and guides 11 may rotate together about the central axis A. By providing independent drive means for the hub 2, guides 11, and disc 4, increased flexibility if provided. This flexibility may be used to obtain optimum operating conditions for a particular material. However, in an alternative embodiment, the guides 11 may be fixedly secured to the hub 2, which is secured to the shaft 3 either directly or through gearing or other linkage, resulting in only one drive means being required.

During operation, the engine 103 drives the shafts 3. This in turn drives the shaft 5, causing the disc 4 to rotate about axis B. The motor 33 causes the hub 2 to rotate about axis A, causing the disc 4 to move in a circular path about axis A into the material to be comminuted. The motor 34 causes the guides 11 to move beneath the screen 10, guiding comminuted material to the exit 12.

For most materials, the hub 2 may be rotated anywhere between 0–12 revolutions per minute and may be able to reverse at the same speed. The disc 4 may be rotated at approximately 600 revolutions per minute.

The engine 103 may include a load sensor 103A, which may for example be a current sensor to detect jamming of the rotor 1. Alternatively, a revolution counter may be used. Should the rotor 1 become jammed or is about to become jammed, the load sensor 103A indicates this to a controller 33A, which either holds the hub 2 in position or reverses the direction of rotation of the hub 2, until the load on the rotor 1 is reduced and/or the revolution rate increases back to normal operating levels. The controller 33A or another controller may automatically cut-out the engine 103 should the rotor 1 remain jammed despite holding or reversing of the hub 2. These operations may also be manually actionable through a suitable user interface (not shown).

Figure 3:
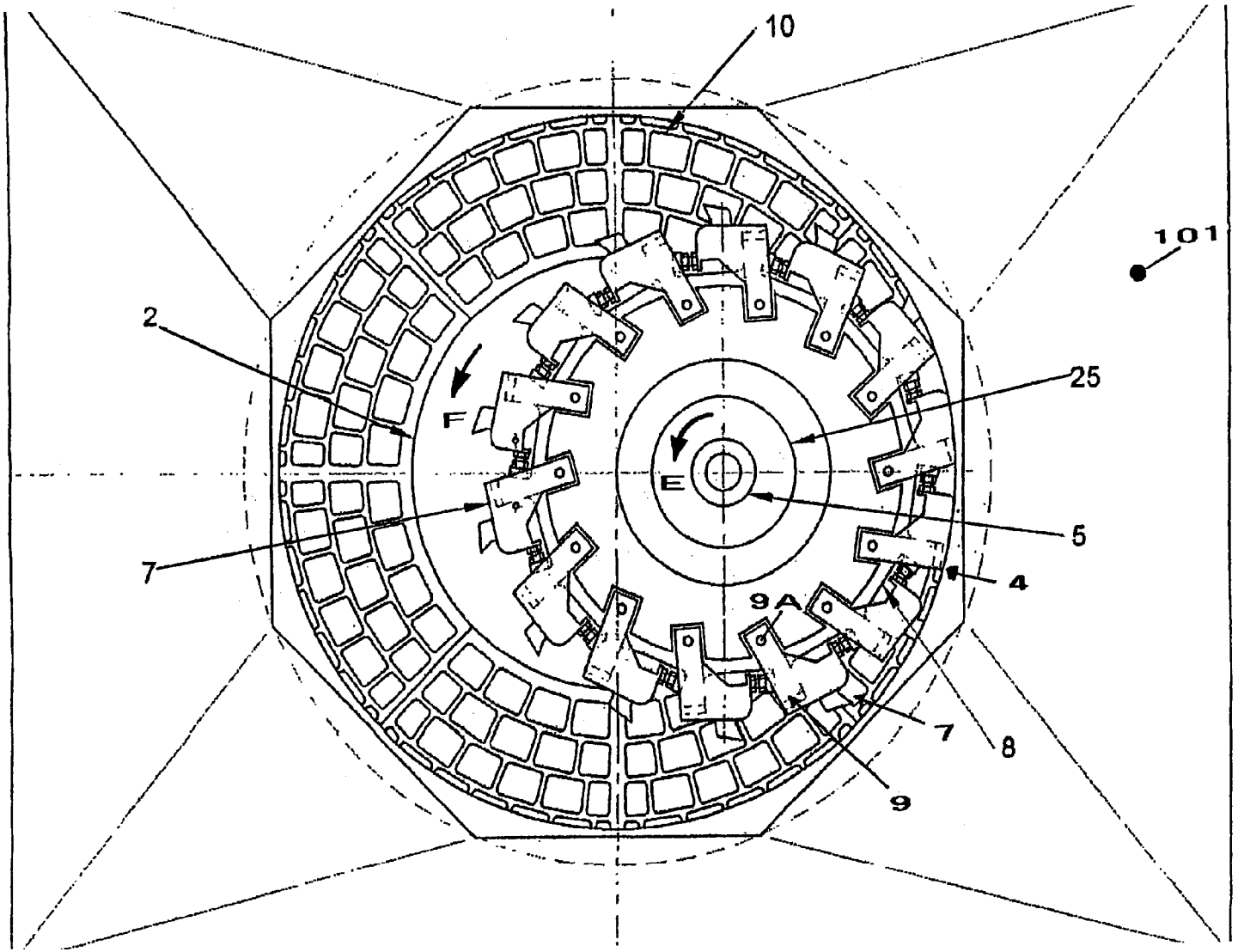
FIG. 3: Shows a plan view of the rotor of FIG. 2.

FIG. 3 shows a plan view of the rotor 1. The hopper 101 feeds material down onto the disc 4, which rotates in the direction indicated by arrow E about the shaft 5. The disc 4 moves about the bottom of the hopper 101 with the rotation of the hub 2, as indicated by arrow F, comminuting material, which falls, is blown or pushed through the screen 10 to the guides 11 (obscured in FIG. 3). The disc 4 includes teeth 7 about its periphery, mounted on an inner disc 8 through mountings 9. The mountings 9 may be pivotally engaged at 9A to the inner disc 8 to allow some movement, which may decrease the rate of breakage of the teeth 7.

The disc 4 may optionally include a plurality of disc members mounted above each other. The disc members may be mounted coaxially and fixedly engaged to each other. Alternatively, the disc members may rotate at different angular velocities, in the same or opposing directions, at a penalty of increased complexity and cost in the drive arrangement for the disc. The disc members may have any alternative shape suitable for comminuting material which the comminuting apparatus is to comminute.

Paddles 29 may optionally be provided to push material away from the axis B, that otherwise may get trapped under the disc 4.

The guides 11 may include arms 11A, shown in outline in FIG. 2, that extend up the outer side of the screen side wall portion 10B. The arms 11A may extend upwards to an extent to be in line with the disc 4 so as to be able to wipe material from the screen side wall portion 10B that may have been forced sideways by the movement of the disc 4.

In another alternative embodiment, the disc 4 may be off-centre of the shaft 5. By locating the disc 4 off-centre of the shaft 5, the horizontal motion of the disc 4 may be increased, which may be advantageous for comminuting particular materials.

Figure 4:
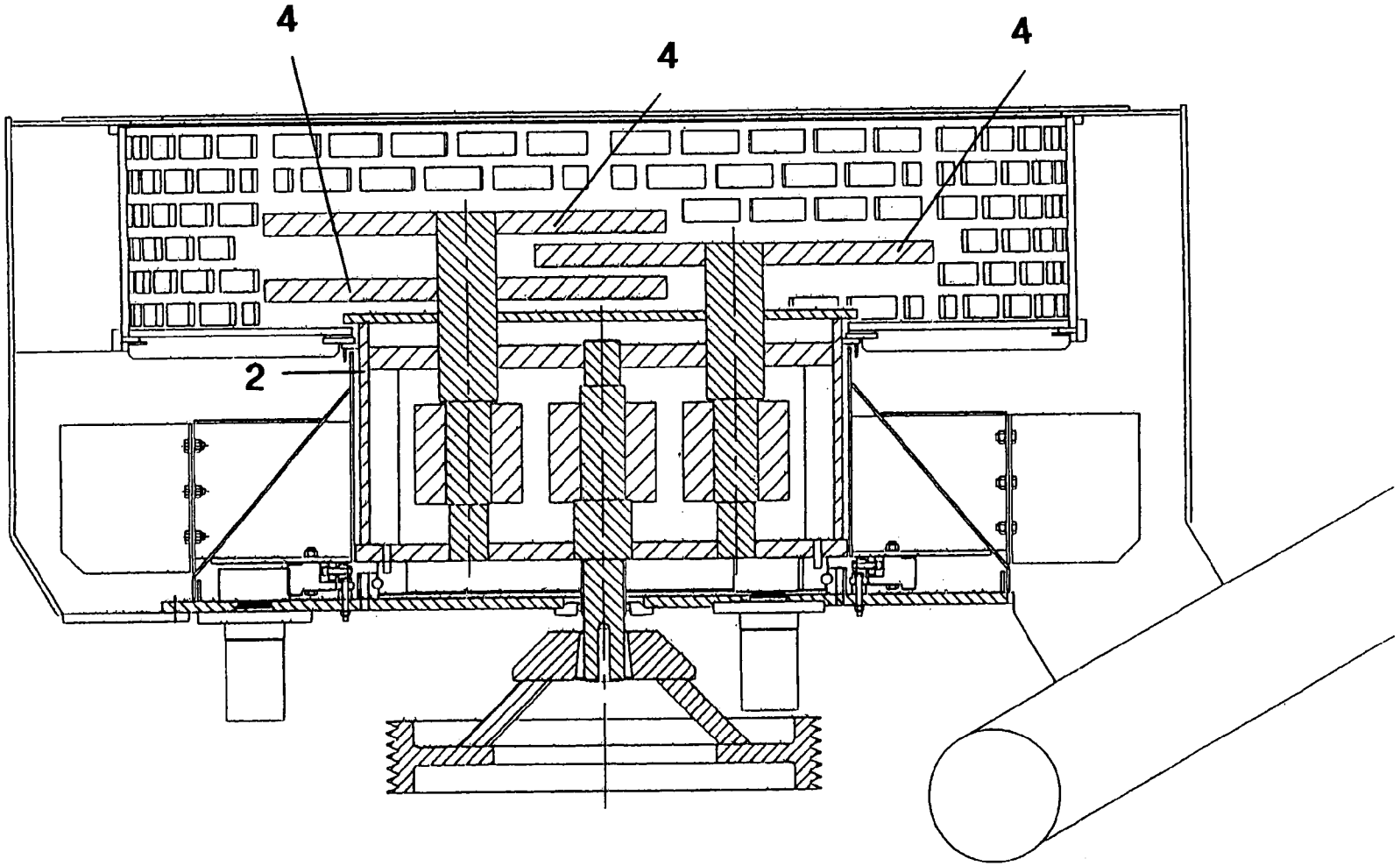
FIG. 4: Shows a sectional view through the rotor of an alternative embodiment of the comminuting apparatus.

FIG. 4 shows a further alternative embodiment in which the comminuting apparatus has an enlarged diameter hub 2 and two discs 4 diametrically opposed from each other. The discs 4 may have a smaller diameter, may intermesh or be located at different heights, with 15 overlapping portions to allow the disc members to be positioned closely. More than two discs 4 may also be provided as shown in FIG. 4, although a single disc 4 has been found suitable for most applications.

The hopper 101 and screens 10 may be constructed from wear resistant steel. The disc 4 may be constructed from mild steel plate with abrasion resistant plates welded on the top face. The guides 11 may be constructed from mild steel.

Where in the foregoing description reference has been made to specific components or integers of the invention having known equivalents then such equivalents are herein incorporated as if individually set forth.

Although this invention has been described by way of example and with reference to possible embodiments thereof, it is to be understood that modifications or improvements may be made thereto without departing from the scope of the invention as defined in the appended claims.

The invention claimed is:

1. A comminuting apparatus, including:

a) a receptacle to receive material to be comminuted and output comminuted material through an exit;

b) a rotor including:

i) a first member rotatable about a first axis, and ii) at least one disc member for comminuting material and rotatable about a second axis removed from said first axis and coupled to said first member through a coupling;

c) at least one drive means to rotate the first member about said first axis, thereby moving said second axis about said first axis through said coupling and to rotate said at least one disc member about said second axis; and d) a screen for comminuted material located between the at least one disc member and said exit.

2. The comminuting apparatus of claim 1, including a plurality of disc members along the second axis, each of the plurality of disc members rotatable about the second axis.

3. The comminuting apparatus of claim 1 including two or more sets of said at least one disc member, distributed about the first axis, at least one of the sets being rotatable about the second axis removed from said first axis and coupled to the first member so as to move about said first axis when in use.

4. The comminuting apparatus of claim 1, wherein the drive means includes a first drive means for the first member and a second drive means, independently controllable from the first drive means, for the at least one disc members.

5. The comminuting apparatus of claim 1 including a sensor to detect jamming of the rotor and a controller in communication with the sensor to control the drive means to stop the rotation of the first member in response to the detection of a jam by the sensor.

6. The comminuting apparatus of claims 1 including a sensor to detect jamming of the rotor and a controller in communication with the sensor to control the drive means to reverse the direction the rotation of the first member in response to a detection of a jam by the sensor.

7. The comminuting apparatus of either claim 5 or claim 6, wherein the controller controls the drive means to resume the original rotation of the first member once the at least one disc member is rotating at or above a predetermined minimum speed.

8. The comminuting apparatus of claim 1, further including at least one guide for directing comminuted material, the at least one guide extending radially outward in relation to said first axis and rotatable about the first axis, below the screen.

9. The comminuting apparatus of claim 8, wherein said at least one guide is rotatable independently of the first member.

10. The comminuting apparatus of claim 8, wherein the screen has a base portion extending across said receptacle below the at least one disc member and above the at least one guide and a side wall portion extending upwards from said base portion at the periphery of the receptacle.

11. The comminuting apparatus of claim 10, wherein the at least one guide includes a peripheral portion that extends towards the at least one disc member beside the side wall portion of the screen.

12. The comminuting apparatus of claim 11, wherein the at least one guide extends towards the at least one disc member beside the side wall portion so as to terminate at least approximately in the plane of the lowest of the one or more disc members.

13. The comminuting apparatus of claim 8, including a baffle below said screen, the baffle shaped to direct comminuted material radially outwards from said first axis, wherein said at least one guide extends radially outward from the outer periphery of said baffle.

14. The comminuting apparatus of claim 1, further including a base portion extending across said receptacle below the at least one disc member and a side wall portion extending upwards from said base portion at the periphery of the receptacle.

15. The comminuting apparatus of claim 1, including a baffle below said screen, the baffle shaped to direct comminuted material radially outwards from said first axis.

* * * * *